US009782812B2

(12) United States Patent
Minch

(10) Patent No.: US 9,782,812 B2
(45) Date of Patent: Oct. 10, 2017

(54) METHOD AND APPARATUS FOR CUTTING OPENINGS IN SIDEWALL OF SPIRAL PIPE

(71) Applicant: Roderick Clarence Minch, Fairview, NC (US)

(72) Inventor: Roderick Clarence Minch, Fairview, NC (US)

( * ) Notice: Subject to any disclaimer, the term of this patent is extended or adjusted under 35 U.S.C. 154(b) by 163 days.

(21) Appl. No.: 14/668,110

(22) Filed: Mar. 25, 2015

(65) Prior Publication Data

US 2015/0273552 A1 Oct. 1, 2015

Related U.S. Application Data

(60) Provisional application No. 61/970,590, filed on Mar. 26, 2014.

(51) Int. Cl.
*B21C 37/12* (2006.01)

(52) U.S. Cl.
CPC ..... *B21C 37/127* (2013.01); *B21C 37/121* (2013.01); *B21C 37/126* (2013.01)

(58) Field of Classification Search
CPC ..... B21C 37/12; B21C 37/121; B21C 37/126; B21C 37/127; B21C 37/128; B21C 37/156; B21C 37/157; B23K 7/006; B23K 7/007; B23K 7/102; B23K 26/006; B21D 28/28; B26D 1/60; B26D 3/001; B26D 3/163
See application file for complete search history.

(56) References Cited

U.S. PATENT DOCUMENTS 4,349,182 A * 9/1982 Blackburn ..... B23K 7/005 219/124.33
4,706,481 A * 11/1987 Castricum ..... B21C 37/127 72/132
4,756,217 A * 7/1988 Holmes ..... B23K 7/006 493/289
6,256,851 B1 * 7/2001 Goedelmann ..... B21C 37/121 29/33 D
6,295,853 B1 * 10/2001 Castricum ..... B21C 37/127 72/132
6,497,633 B1 * 12/2002 Butterfield ..... F16G 5/16 29/33 D
7,695,420 B2 * 4/2010 Gelli ..... B26D 1/58 493/276
8,683,841 B1 * 4/2014 Walsh ..... B21C 37/122 219/121.36
2002/0100304 A1 * 8/2002 Price ..... B21C 37/121 72/50
2003/0230127 A1 * 12/2003 Castricum ..... B01D 29/111 72/49

(Continued)

*Primary Examiner* — Edward Tolan
(74) *Attorney, Agent, or Firm* — The Webb Law Firm

(57) ABSTRACT

An apparatus for forming spiral pipe includes a spiral pipe forming station having a feeding device for feeding a continuous strip and a bending device that receives the strip fed from the feeding device. The bending device has a fixed rolling element that forms a spiral pipe having a longitudinal axis and a sidewall. The apparatus also includes a cutting station having a cutting device movably extending in a direction of the longitudinal axis of the spiral pipe. A controller is operatively connected to the spiral pipe forming station and the cutting station to continuously operate the pipe forming station while the cutting station is operated to cut through the sidewall of the spiral pipe to define the one or more register holes.

16 Claims, 4 Drawing Sheets

(56) References Cited

U.S. PATENT DOCUMENTS

| | | | | |
|---|---|---|---|---|
| 2007/0245798 | A1* | 10/2007 | Yang | B60B 35/16<br>72/367.1 |
| 2008/0072642 | A1* | 3/2008 | Zepp | B21C 37/121<br>72/49 |
| 2015/0040372 | A1* | 2/2015 | Suzuki | F16L 9/02<br>29/516 |

* cited by examiner

METHOD AND APPARATUS FOR CUTTING OPENINGS IN SIDEWALL OF SPIRAL PIPE

CROSS-REFERENCE TO RELATED APPLICATIONS

This application claims priority to U.S. Provisional Patent Application No. 61/970,590, entitled "Method and Apparatus for Cutting Openings in Sidewall of Spiral Pipe" and filed on Mar. 26, 2014, the disclosure of which is incorporated by reference herein in its entirety.

BACKGROUND OF THE INVENTION

Field of the Invention

The present disclosure relates generally to a method and apparatus for cutting one or more openings in a sidewall of a spiral pipe. More particularly, the present disclosure relates to a method and apparatus for cutting one or more openings in a sidewall of the spiral pipe, such as register holes or taps, wherein the one or more register holes and/or taps are cut as the spiral pipe is formed.

Description of the Related Art

Spiral pipes, such as pipes used for ductwork in the heating and air conditioning industry, are well known. In general, the spiral pipe is formed from a single continuous strip of sheet metal which is rolled and joined at the seam of overlapping sections. The strip of sheet metal first passes through one or more flange forming rollers that bend the side edges of the strip. The strip is then fed at an angle and engages a drum-like forming head that curls the strip in a helical manner. The side edges of adjacent sections of the strip are joined and compressed to form a locking seam. By varying the width of the sheet metal strip, the angle at which the sheet metal strip is fed into a pipe forming machine, and the shape and size of the forming head, the diameter, length, and the shape of the spiral pipe can be controlled. Various pipe forming machines exist in the art to form spiral pipes of various diameters and lengths.

Conventional pipe forming machines are configured only to form a length of pipe. Additional secondary operations, such as cutting of the openings to receive heating and air conditioning registers and taps, are performed independently of the pipe forming machine. For example, in order to cut a register hole or a tap on a preformed spiral pipe, a template of the opening is first outlined on the exterior sidewall of the pipe and the opening is then cut out using sheet metal shears or a powered sheet metal cutting tool. This process is labor intensive. In a large building, dozens of register holes and/or taps must be cut in the spiral pipe ductwork. Because the cutting process is performed manually, significant time and cost must be dedicated to this operation. Even in instances where register and/or tap hole cutting is performed by a machine, a spiral pipe is first be formed, after which the spiral pipe is loaded to a separate machine for cutting the register holes and/or taps.

SUMMARY OF THE INVENTION

Accordingly, in view of the disadvantages of the existing methods and devices for forming openings in the sidewall of a spiral pipe, a method and apparatus for forming spiral pipe and cutting the openings is desired. In accordance with some aspects, an apparatus for forming spiral pipe and cutting one or more register holes and/or taps in the spiral pipe may include a spiral pipe forming station and a cutting station. The spiral pipe forming station may include a feeding device for feeding a continuous metal strip and a bending device that receives the metal strip fed from the feeding device. The bending device may have for a fixed rolling element that continuously bends the metal strip at an angle offset from a central axis of the fixed rolling element to form a spiral pipe having a longitudinal axis and a sidewall. The spiral pipe forming station may further include a flange forming device for forming side edges of the metal strip into mating profiles configured for forming a spiral locking seam. The cutting station for cutting the one or more openings through the sidewall of the spiral pipe may include a cutting device movable in a direction of the longitudinal axis of the spiral pipe. The cutting device may be operated to selectively cut through the sidewall of the spiral pipe to define the one or more openings as the pipe forming station forms the spiral pipe.

In accordance with other aspects, a controller may be operatively connected to the spiral pipe forming station and the cutting station. The controller may be configured to continuously operate the pipe forming station to form the spiral pipe while the cutting station is operated to selectively cut through the sidewall of the spiral pipe to define the one or more openings at predetermined locations on the sidewall of the spiral pipe. The cutting station may further include a movable boom for mounting the cutting device. The movable boom may be movable in an axial direction along the longitudinal axis of the spiral pipe. The movable boom may also be rotatable about the longitudinal axis of the spiral pipe. The cutting device may include a plasma torch directed to an inside surface of the spiral pipe or a laser cutter.

In accordance with some aspects, during cutting of the one or more openings, the cutting station may be operated simultaneously with the pipe forming station to cut the one or more openings while the spiral pipe is being formed. The cutting device may move at a same rate and in a same axial direction as the pipe forming station. The cutting device may move at a different rate in an axial direction than the pipe forming station. The cutting device may sequentially perform a series of continuous cuts as the pipe forming station operates. The cutting station may be further configured for cutting off a length of the spiral pipe after the spiral pipe is formed by the spiral pipe forming station. The pipe forming station may move the spiral pipe in a direction of the longitudinal axis and rotate the spiral pipe about the longitudinal axis. The feeding device may be one or more rollers operated by a motor. The bending device may have one or more rollers and a fixed rolling element.

In accordance with other aspects, a method for forming a spiral pipe and cutting one or more openings in the spiral pipe may include forming the spiral pipe by: feeding a continuous metal strip into a bending device, bending the metal strip to form a spiral pipe having a longitudinal axis and a sidewall, forming a flange on the metal strip by shaping the side edges of the metal strip into mating profiles using a flange forming device, and joining the mating profiles of the metal strip to form a spiral locking seam. The method may further include cutting with a cutting device through the sidewall of the spiral pipe to define the one or more openings. The cutting may be performed while forming the spiral pipe. The method may further include rotating and axially moving the spiral pipe while cutting the one or more openings. The cutting may include moving the cutting device axially in a direction of the longitudinal axis of the spiral pipe. The method may further include cutting off a length of the spiral pipe after the spiral pipe is formed.

These and other features and characteristics of the apparatus for cutting openings in a spiral pipe, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
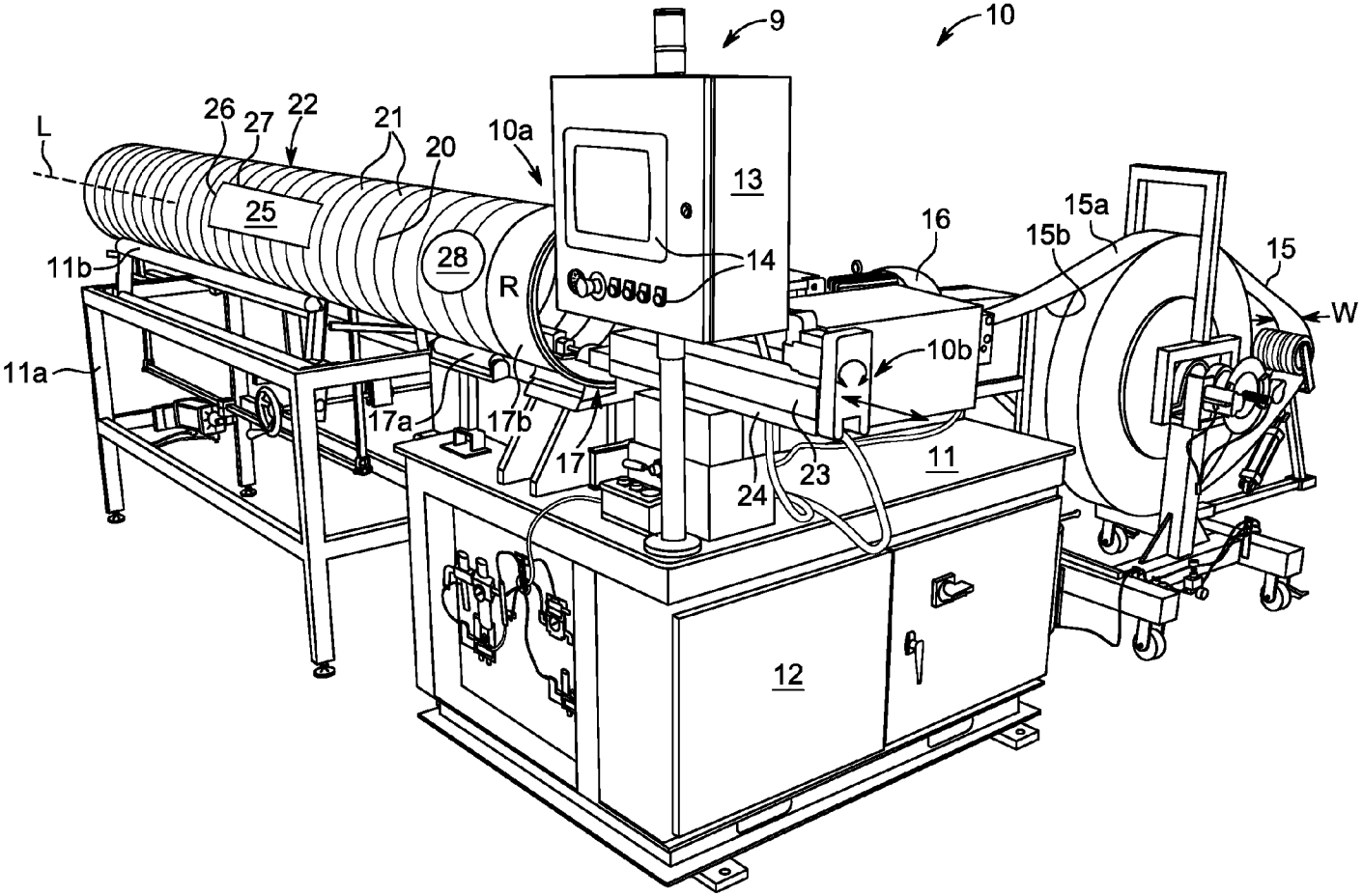
FIG. 1 is a front perspective view of an apparatus for forming spiral pipe and cutting register holes and/or taps in the sidewall of the spiral pipe in accordance with one aspect of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary aspects of the invention. Hence, specific dimensions and other physical characteristics related to the aspects disclosed herein are not to be considered as limiting.

All documents, such as but not limited to issued patents and patent applications, referred to herein, and unless otherwise indicated, are to be considered to be "incorporated by reference" in their entirety.

Figure 2:
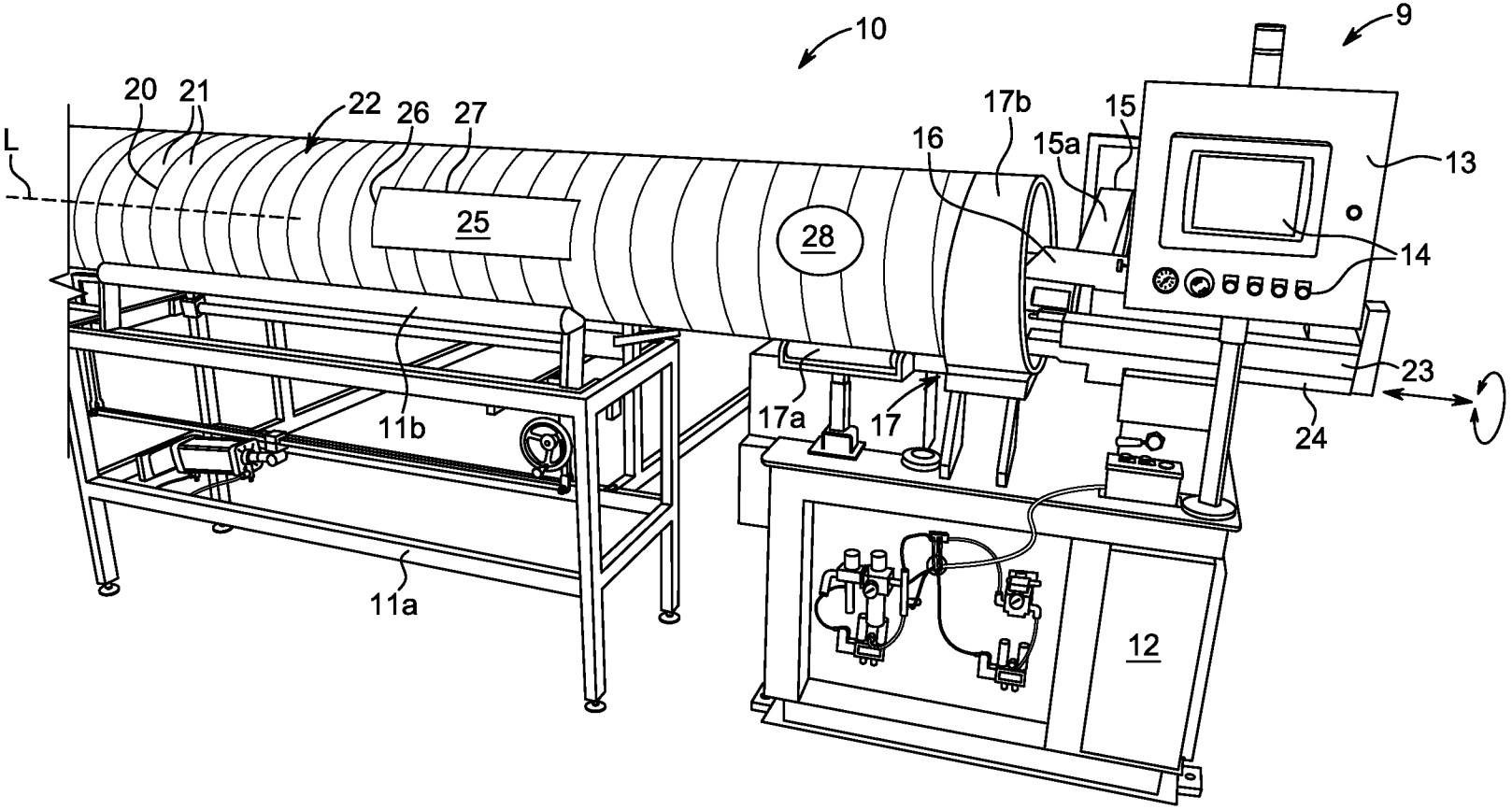
FIG. 2 is a side perspective view of the apparatus shown in FIG. 1.
Figure 3:
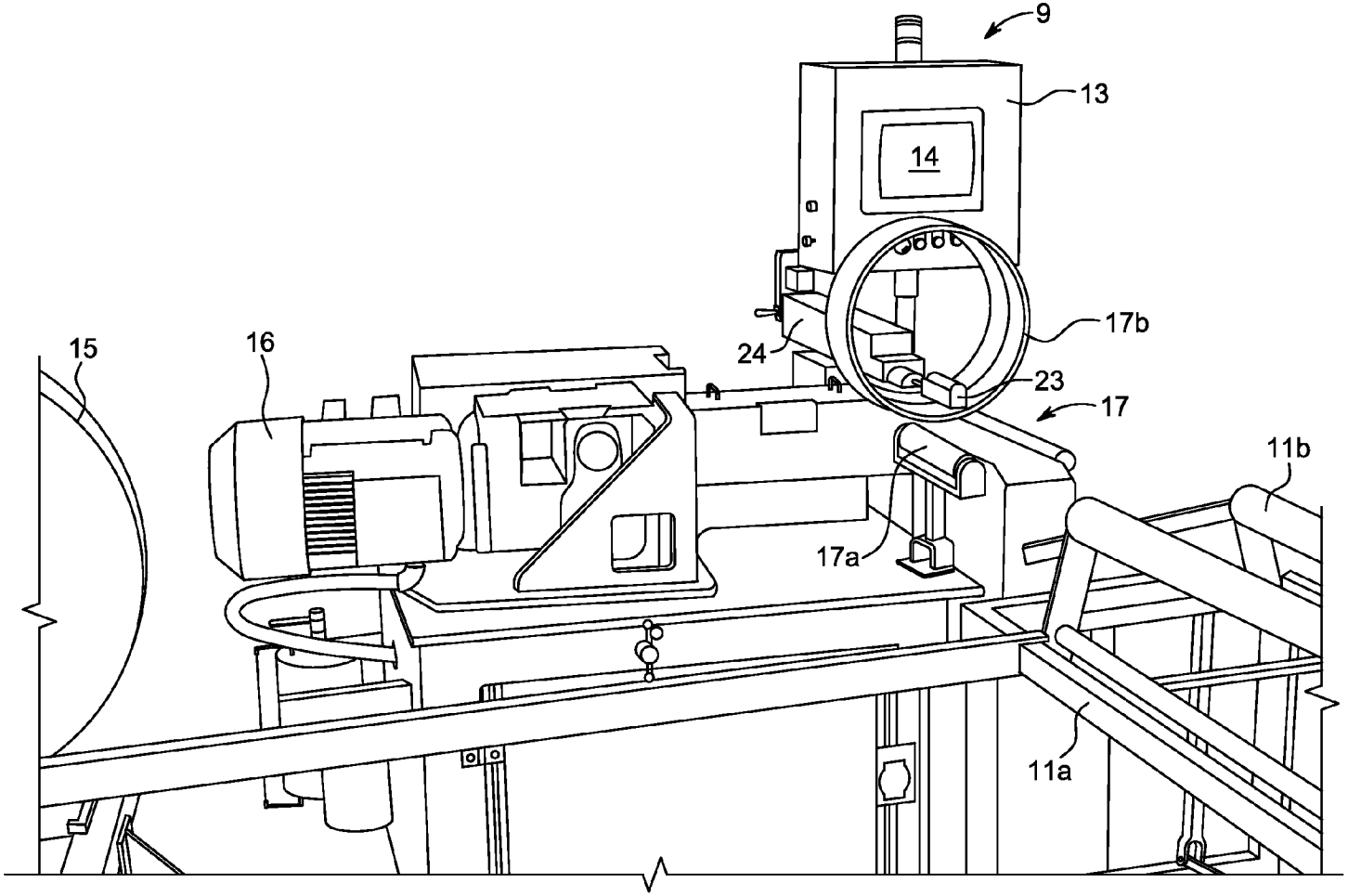
FIG. 3 is a detailed perspective view of a cutting station of the apparatus shown in FIG. 1.

Referring to FIGS. 1-2, an apparatus for cutting register holes and/or taps in a sidewall of a spiral pipe is illustrated in accordance with one aspect. The apparatus, hereinafter referred to as apparatus 10, generally includes a spiral pipe forming station 10*a* and a pipe cutting station 10*b*. The pipe forming station 10*a* and the cutting station 10*b* are mounted on a frame 11. A control cabinet 12 and a control panel 13 contain a plurality of control elements 14, such as knobs, gauges, dials, and various other input and output devices for controlling and monitoring the operation of the apparatus 10. The control cabinet 12, the control panel 13, and the control elements 14 define a controller 9 for controlling the operation of the pipe forming station 10*a* and the cutting station 10*b*, as will be described hereinafter. The controller 9 may be configured for controlling the spiral pipe rolling and/or cutting operations. For example, the controller 9 may include a variety of discrete computer-readable media components for controlling the spiral pipe rolling and/or cutting operations. A user may enter commands, information, and data into the controller 9 through certain attachable or operable input devices via a user input interface. A variety of such input devices may be utilized, e.g., a microphone, a trackball, a joystick, a touchpad, a touch-screen, a scanner, etc., including any arrangement that facilitates the input of data and information to the controller 9 from an outside source. Data and information can be presented or provided to a user in an intelligible form or format through certain output devices, such as a monitor (to visually display this information and data in electronic form), a printer (to physically display this information and data in print form), a speaker (to audibly present this information and data in audible form), etc. All of these devices are in communication with the controller 9 through an output interface. It is envisioned that any such peripheral output devices be used to provide information and data to the user. The controller 9 may operate in a network environment through the use of a communications device, which is integral to the controller or remote therefrom. As used herein, the controller 9 includes, or is operable to execute appropriate custom-designed or conventional software to perform and implement the processing steps of the method and system of the present disclosure, thereby forming a specialized and particular computing system. Accordingly, the presently-invented method and system may include one or more controllers 9 to execute, configure, or otherwise implement the methods, processes, and transformational data manipulations discussed herein in connection with the present disclosure.

With reference to FIGS. 1-2, a continuous strip 15 is fed into the apparatus 10. The strip 15 has a top surface 15*a*, which defines an interior portion of a spiral pipe 22, and a bottom surface 15*b* (shown in FIG. 1), which defines an exterior portion of the spiral pipe 22. In various aspects, the strip 15 may be formed from metal, such as aluminum, steel, or one or more alloys thereof. The strip 15 may also be formed from a composite material, such as plastic or carbon fiber. The apparatus 10 is configured to receive various widths W of the strip 15, depending on a desired diameter of the spiral pipe 22. A feeding device 16, such as one or more rollers operated by a motor, feeds the strip 15 into a bending device 17 having a fixed rolling element 17*b* with a predetermined radius of curvature R. The radius of curvature R of the fixed rolling element 17*b* determines an outer diameter of the spiral pipe 22. A rolled spiral pipe 22 is supported on support rollers 17*a*.

Figure 4:
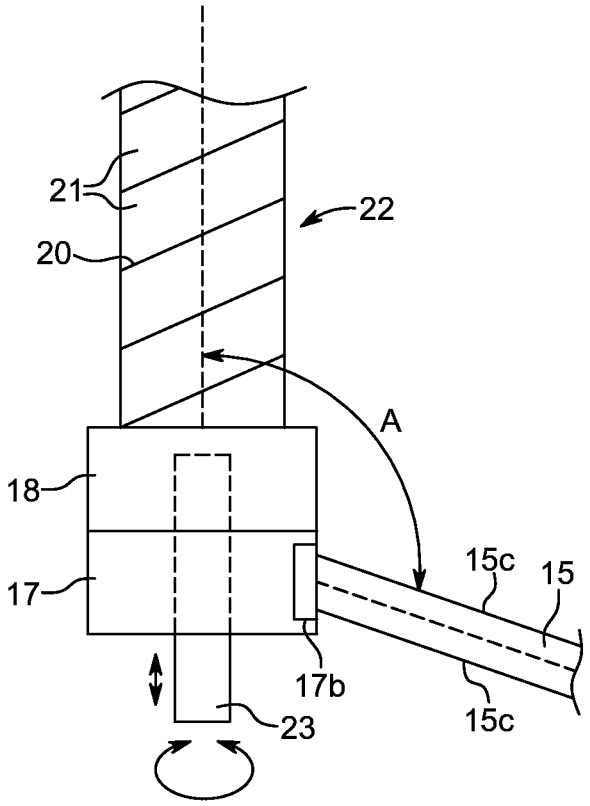
FIG. 4 is a schematic top view of the apparatus shown in FIG. 1.
Figure 5:
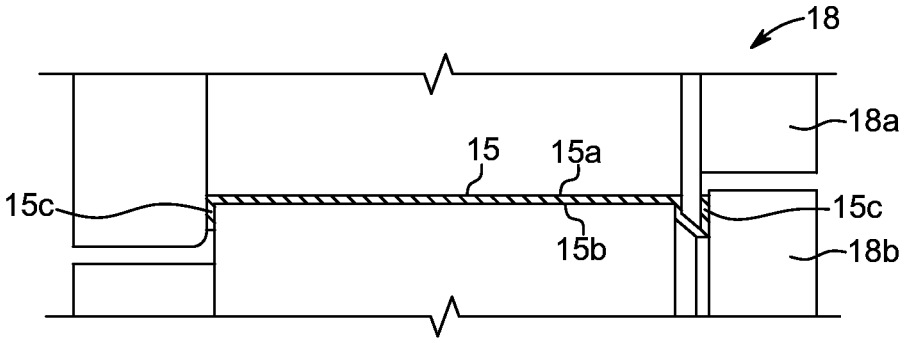
FIG. 5 is a side cross-sectional view of a flange forming device.

With reference to FIG. 4, the strip 15 is fed at an angle A relative to a longitudinal axis of the fixed rolling element 17*b*. The angle A at which the strip 15 is fed into the bending device 17 may be varied such that spiral pipes of various diameters may be formed. With reference to FIG. 4, the apparatus 10 further includes a flange forming device 18 that has one or more flange forming rollers 18*a*, 18*b* which bend the edges 15*c* of the strip 15 into a predetermined mating profile for forming a locking seam 20. The strip 15 is fed by the feeding device 16 into the bending device 17, where the strip 15 is bent to have a plurality of adjacent helical portions 21. As the strip 15 is bent, the flange forming device 18 forms the locking seam 20 (shown in FIG. 5) on the edges 15*c* of each helical portion 21 such that the locking seam 20 of one helical portion 21 matingly engages the locking seam 20 of helical portions 21 adjacent to either side of it. The locking seams 20 are desirably pressed together to connect the adjacent helical portions 21 and define a spiral pipe 22. As a length of the spiral pipe 22 is formed, it is supported on a support table 11*a* having one or more rollers 11*b* (shown in FIGS. 1-2) that allow the spiral pipe to rotate as it is formed.

With reference to FIGS. 1-2, the cutting station 10*b* includes a cutting device 23. The cutting device 23 is positioned such that it is extendable into an interior of the spiral pipe 22 along a longitudinal axis L of the spiral pipe 22. In one aspect, the cutting device 23 is a plasma torch. In other aspects, the cutting device 23 may be a laser cutter or any other cutting device capable of cutting through the sidewall of the strip 15 from one side. In other aspects, the cutting device 23 may have a first component provided within an interior portion of the spiral pipe 22 and a second component provided on an exterior portion of the spiral pipe 22. The first and second components together may coact to cut through the sidewall of the spiral pipe 22. The cutting device 23 is desirably positioned on a movable boom 24. The boom 24 is configured for moving the cutting device 23 relative to the support table 11*a* that supports the spiral pipe 22. Depending on a desired cutting operation, the boom 24 may be movable relative to the spiral pipe 22, such as when the spiral pipe is stationary. In other aspects, the boom 24 may be movable as the spiral pipe 22 is rotated and moved in an axial direction along the longitudinal axis L. The boom 24 is movable axially along the longitudinal axis L of the spiral pipe 22. Additionally, the boom 24 may be rotatable about the longitudinal axis L of the spiral pipe 22. In some aspects, the boom 24 may be simultaneously movable axially along the longitudinal axis L and rotatable about the longitudinal axis L of the spiral pipe 22. The cutting device 23 is operative for cutting through the sidewall of the spiral pipe 22, as described herein.

The apparatus 10 is configured to enable several cutting operations, depending on the desired end result. For example, in one aspect, the apparatus 10 is operable to control the cutting station 10*b* to cut the end of the spiral pipe 22 by forming a continuous cut that extends along the entire circumference of the spiral pipe 22. In this manner, a spiral pipe 22 having a desired length can be formed. In another aspect, the apparatus 10 is operable to control the cutting station 10*b* to make several cuts at predetermined locations on the spiral pipe 22 in order to cut an opening 25, such as a register hole configured for receiving a conventional heating/ventilation register. The opening 25 may be substantially rectangular or square. In other aspects, the apparatus 10 is operable to control the cutting station 10*b* to cut a tap 28 having a substantially elliptical shape for joining a second spiral pipe (not shown) at an angle relative to the first spiral pipe 22. The size and shape of the tap 28 is selected based on the relative diameters of the intersecting spiral pipes and the angle at which they intersect.

In a first cutting operation, where the cutting station 10*b* is operated to cut the end of the spiral pipe 22, the boom 24 of the cutting device 23 moves at the same rate and in the same direction as the spiral pipe 22 is advanced axially. In this manner, the cutting device 23 remains in a same axial position with reference to a predetermined cutting point on the spiral pipe 22 such that the spiral pipe 22 is cut off at an angle that is substantially perpendicular to the longitudinal axis of the spiral pipe 22. The cutting process is continuous over one full revolution of the spiral pipe 22 about its circumference such that a section of spiral pipe 22 is formed.

In a second cutting operation, where one or more register holes 25 or taps 28 are cut, the cutting process is performed by making a plurality of individual cuts through the sidewall of the spiral pipe 22. The cuts may be performed sequentially in a continuous, uninterrupted process. When configured to fit a substantially rectangular register, each register hole 25 has a pair of first edges 26 that are substantially perpendicular to the longitudinal axis L of the spiral pipe 22. The first edges 26 may be parallel to each other and are axially separated from one other. The register hole 25 further has a pair of second edges 27 that are substantially perpendicular to the first edges 26 and are radially separated from one other along an outer circumference of the spiral pipe 22. The terminal ends of the second edges 27 are connected to the terminal ends of the first edges 26. To cut the register hole 25, the cutting device 23 performs four individual cutting operations to cut each of the first and second edges 26, 27. For example, the second edges 27 can be cut by moving the boom 24 of the cutting device 23 at the same rate and in the same direction as the spiral pipe 22 is advanced. In contrast to the cutting operation where the entire end of the spiral pipe 22 is cut off, the cutting device 23 is operated only during the rotational movement of the spiral pipe 22 that is equal to the length of the second edge 27. The first edges 26 are cut by advancing the boom 24 of the cutting device 23 while the spiral pipe 22 is maintained stationary. Alternatively, the first of the first edges 26 is cut by advancing the boom 24 of the cutting device 23 at a faster rate and in a same axial direction as the spiral pipe 22 is advanced. The second of the first edges 26 can be cut by retracting the boom 24 of the cutting device 23 at a faster rate and in the opposite axial direction as the spiral pipe 22 is advanced. During the cutting process of the first edges 26, the boom 24 may be rotated to track the sidewall of the spiral pipe 23. In other aspects, the cutting device 23 may be moved axially and rotated about the longitudinal axis L of the spiral pipe 22. Movement of the boom 24 and the speed at which the spiral pipe 22 is advanced from the pipe forming station 10*a* can be controlled by the controller in order to optimize the process for cutting the register hole 25. Similarly, a tap 28 can be cut by controlling the speed and direction of the boom 24 relative to the speed and direction at which the spiral pipe 22 is advanced.

The register hole 25 and/or the tap 28 can be cut by a continuous cutting process that does not interrupt the axial advancement of the spiral pipe 22. In this manner, the register hole 25 and/or the tap 28 are cut as the spiral pipe 22 is formed, without interrupting the pipe forming process. Such operation achieves a substantial time savings for the cutting of the register hole 25 and or the tap 28 compared to conventional methods.

While various aspects of the method and apparatus for forming spiral pipe and cutting register holes and/or taps in the sidewall of the spiral pipe were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

What is claimed is:

1. An apparatus for forming a spiral pipe and cutting one or more openings in the spiral pipe, the apparatus comprising:

a spiral pipe forming station, the spiral pipe forming station comprising:

a feeding device for feeding a continuous metal strip;

a bending device that receives the metal strip fed from the feeding device, the bending device having a fixed rolling element that continuously bends the metal strip at an angle offset from a central axis of the fixed rolling element to form a spiral pipe in a pipe forming direction, the spiral pipe having a longitudinal axis and a sidewall;

a flange forming device for forming side edges of the metal strip into mating profiles configured for forming a spiral locking seam;

a cutting station for cutting the one or more openings through the sidewall of the spiral pipe while the spiral pipe is being formed in the pipe forming direction, the cutting station comprising a cutting device movable in a direction of the longitudinal axis of the spiral pipe; and a controller operatively connected to the spiral pipe forming station and the cutting station, wherein the controller is configured to continuously operate the pipe forming station to form the spiral pipe while the cutting station is operated to selectively cut through the sidewall of the spiral pipe to define the one or more openings as a series of continuous cuts at predetermined locations on the sidewall of the spiral pipe between terminal ends of the spiral pipe while the spiral pipe is being formed in the pipe forming direction.

2. The apparatus of claim 1, wherein the cutting station further comprises a movable boom for mounting the cutting device.

3. The apparatus of claim 2, wherein the boom is movable in an axial direction along the longitudinal axis of the spiral pipe.

4. The apparatus of claim 3, wherein the boom is rotatable about the longitudinal axis of the spiral pipe.

5. The apparatus of claim 1, wherein the cutting device is a plasma torch directed to an inside surface of the spiral pipe.

6. The apparatus of claim 1, wherein the cutting device is a laser cutter.

7. The apparatus of claim 1, wherein the cutting device moves at a same rate and in a same axial direction as the pipe forming station.

8. The apparatus of claim 1, wherein the cutting device moves at a different rate in an axial direction than the pipe forming station.

9. The apparatus of claim 1, wherein the cutting station is further configured for cutting off a length of the spiral pipe after the spiral pipe is formed by the spiral pipe forming station.

10. The apparatus of claim 1, wherein the pipe forming station rotates the spiral pipe about the longitudinal axis.

11. The apparatus of claim 1, wherein the feeding device is one or more rollers operated by a motor.

12. The apparatus of claim 1, wherein the bending device has one or more rollers and a fixed rolling element.

13. A method for forming a spiral pipe and cutting one or more openings in the spiral pipe, the method comprising:

forming the spiral pipe in a pipe forming direction by:

feeding a continuous metal strip into a bending device;

bending the metal strip to form a spiral pipe having a longitudinal axis and a sidewall;

forming a flange on the metal strip by shaping the side edges of the metal strip into mating profiles using a flange forming device;

joining the mating profiles of the metal strip to form a spiral locking seam; and cutting with a cutting device through the sidewall of the spiral pipe to define the one or more openings as a series of continuous cuts between terminal ends of the spiral pipe, wherein cutting is performed while forming the spiral pipe in the pipe forming direction.

14. The method of claim 13, further comprising rotating and axially moving the spiral pipe while cutting the one or more openings.

15. The method of claim 13, wherein cutting comprises moving the cutting device axially in a direction of the longitudinal axis of the spiral pipe.

16. The method of claim 13, further comprising cutting off a length of the spiral pipe after the spiral pipe is formed.

* * * * *